US011634661B2

(12) United States Patent
Boutique et al.

(10) Patent No.: US 11,634,661 B2
(45) **Date of Patent: *Apr. 25, 2023**

(54) LAUNDRY DETERGENT COMPOSITIONS WITH IMPROVED GREASE REMOVAL

(71) Applicant: The Procter & Gamble Company, Cincinnati, OH (US)

(72) Inventors: Jean-Pol Boutique, Gembloux (BE); Aicha Dkidak, Brussels (BE); Bill Karel Mahieu, Brussels (BE); Patrick Christopher Stenger, Fairfield, OH (US); Denis Alfred Gonzales, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 494 days.

This patent is subject to a terminal disclaimer.

(21) Appl. No.: 15/969,802

(22) Filed: May 3, 2018

(65) Prior Publication Data

US 2018/0320108 A1 Nov. 8, 2018

(30) Foreign Application Priority Data

May 5, 2017 (EP) ..... 17169631
Jan. 30, 2018 (EP) ..... 18154155

(51) Int. Cl.

| | |
|---|---|
| ***C11D 1/00*** | (2006.01) |
| ***C11D 1/831*** | (2006.01) |
| ***C11D 3/43*** | (2006.01) |
| ***C11D 3/20*** | (2006.01) |
| ***C11D 11/00*** | (2006.01) |
| ***C11D 1/83*** | (2006.01) |
| *C11D 1/29* | (2006.01) |
| *C11D 1/72* | (2006.01) |
| *C11D 1/22* | (2006.01) |

(52) U.S. Cl.

CPC ..... *C11D 1/831* (2013.01); *C11D 1/83* (2013.01); *C11D 3/201* (2013.01); *C11D 3/2017* (2013.01); *C11D 3/43* (2013.01); *C11D 11/0017* (2013.01); *C11D 1/22* (2013.01); *C11D 1/29* (2013.01); *C11D 1/72* (2013.01)

(58) Field of Classification Search

CPC ..... C11D 3/201; C11D 3/2017; C11D 1/83; C11D 1/831; C11D 1/22

See application file for complete search history.

(56) References Cited

U.S. PATENT DOCUMENTS

| | | | | |
|---|---|---|---|---|
| 3,856,695 | A | 12/1974 | Geiss et al. | |
| 4,561,991 | A | 12/1985 | Herbots et al. | |
| 4,692,260 | A * | 9/1987 | Sung | C11D 3/38627 510/505 |
| 5,608,118 | A | 3/1997 | Dahlgren et al. | |
| 5,661,121 | A | 8/1997 | Dahlgren et al. | |
| 5,674,645 | A | 10/1997 | Amatucci et al. | |
| 5,968,888 | A | 10/1999 | Blandiaux | |
| 6,037,317 | A * | 3/2000 | Rapisarda | C11D 1/83 510/280 |
| 6,989,360 | B2 | 1/2006 | Danner et al. | |
| 2004/0142846 | A1 | 7/2004 | Hines et al. | |
| 2009/0029899 | A1 | 1/2009 | Grainger et al. | |
| 2011/0146001 | A1 | 6/2011 | Woo et al. | |
| 2012/0222348 | A1 | 9/2012 | Bohnke | |
| 2012/0252716 | A1* | 10/2012 | Barnabas | C11D 3/0015 510/515 |
| 2015/0353869 | A1* | 12/2015 | Stenger | C11D 17/042 510/324 |
| 2017/0015949 | A1* | 1/2017 | Johnson | C11D 3/38636 |
| 2017/0087260 | A1 | 3/2017 | Tuerler et al. | |
| 2017/0137745 | A1* | 5/2017 | Tang | C11D 1/146 |
| 2017/0145345 | A1* | 5/2017 | Gonzales | B08B 1/006 |
| 2017/0275566 | A1 | 9/2017 | Scialla et al. | |
| 2018/0320109 | A1 | 11/2018 | Boutique et al. | |

FOREIGN PATENT DOCUMENTS

| | | | |
|---|---|---|---|
| DE | 4021265 | A1 | 1/1992 |
| EP | 0666308 | A2 | 8/1995 |
| WO | 9919449 | A1 | 4/1999 |
| WO | 03006734 | A2 | 1/2003 |
| WO | WO2012117004 | A2 | 9/2012 |

OTHER PUBLICATIONS

U.S. Appl. No. 15/969,806, filed May 3, 2018, Jean-Pol Boutique.
Search_report for EP application No. 17169631.3-1375, dated Nov. 16, 2017, 9 pages.
SEarch_report for EP application No. 17169644.6, dated Nov. 8, 2017, 12 pages.
All Office Actions; U.S. Appl. No. 15/969,806.
Extended European Search Report and Search Opinion for 18154155.8 dated Aug. 13, 2018 9 pages.
International Search Report and Written Opinion for PCT/US2018/030752 dated Aug. 13, 2018, 15 pages.

* cited by examiner

*Primary Examiner* — Necholus Ogden, Jr.

(57) ABSTRACT

Compositions, such as laundry detergent compositions, that include detersive surfactant and C4-C10 alkyl branched alcohol.

18 Claims, No Drawings

LAUNDRY DETERGENT COMPOSITIONS WITH IMPROVED GREASE REMOVAL

FIELD OF THE INVENTION

The present disclosure relates to laundry detergent compositions, especially liquid laundry detergent compositions for cleaning grease stains.

BACKGROUND OF THE INVENTION

Laundry detergent compositions are formulated to provide good cleaning to fabrics: To keep white fabrics white, and to keep coloured fabrics bright. The laundry detergent compositions are also typically formulated to remove stains. A stain is a local discoloration that can be clearly distinguished on the fabric it is found upon. Since they result in a discoloration that strongly contrasts with the unstained fabrics, they are particularly noticeable on fabrics.

Grease-containing stains remain challenging to remove, especially at low temperatures. Various organic solvents, including terpenes and terpene-like compounds, are rather well-known for use in hard surface cleaners for their grease removal ability. Such cleaners often contain 10%, or more, of a solvent such as d-limonene, together with a surfactant, especially nonionic surfactants which are also well-known for their grease removal performance Hard surface cleaners comprising a mixture of benzyl alcohol, terpenes, surfactants and other detersive ingredients are known. High composition pH also improves grease cleaning. However, high pH can also damage fabrics and fabric colour, especially for delicate fabrics, and especially during direct application, for instance during pretreatment.

Moreover, laundry detergent compositions are typically significantly diluted during the laundry wash. Even pretreating grease-containing stains remains challenging, since the grease is typically heavily impregnated into the fabric and the time for the laundry detergent composition to penetrate the stain is short, especially considering the hydrophobic nature, and hence water-repellency, of such grease-containing stains.

While the use of relatively high concentrations of solvents in heavy duty liquid laundry detergents improves stain penetration during pretreatment, higher solvent levels have disadvantages such as damaging delicate fabrics and affecting color retention on fabrics. Moreover, solvents typically lower the viscosity of liquid laundry detergent compositions.

As such, a need remains for laundry compositions, especially liquid laundry detergent compositions which are suitable for use in pretreating, which provide improved removal of grease-containing stains while not damaging delicate fabrics. A further need remains for such compositions which provide improved removal of grease-containing stains, while not requiring high levels of the solvent, even during washing without pretreatment.

Stain removal compositions which comprise mixtures of grease-cutting solvents and polyamines for removing stains comprising a mixture of grease and particulate matter from fabrics are known. C5-15-alkanols in foam inhibitors for biodiesel fuel or diesel fuel-biodiesel blends are known. The use of an alkoxylate of 2-propyl-1-heptanol for degreasing is known. Multi-purpose aqueous cleaning compositions comprising hydrogen peroxide, a 2-alkyl alkanol, a hydrophobic surfactant having an HLB below 14 and an anionic surfactant are known. Solvent-based detergent compositions which consist essentially of 10-80% liquid aliphatic chlorinated hydrocarbon solvents, 10-40% liquid aliphatic ketones and/or liquid aliphatic esters, 6 to 50% water soluble liquid alkanols having two to five carbon atoms and 1-10% surface active agents are known. Emulsions for cleaning, the emulsions containing water, one or more anionic surfactants from a group of selected molecular weight carboxylic acid salts, and one or more organic solvents so that the compositions have low conductivity and low viscosity, are known. Aqueous textile fibre degreasing agents essentially consisting of at least one amine oxide, at least one hexanediol, at least one secondary, branched or cyclic hexanol, at least one amino-surfactant, and water, and optionally at least one formulation additive are known. The use of saturated secondary alcohols with branching in the alpha-position to the OH and with molecular weight of 210-300 as additives to washing compositions is known. The use of an alcohol in a liquid cleaning composition comprising surfactant, for cleaning hydrophobic stains from surfaces and/or for providing suds longevity, wherein the alcohol is selected from the group consisting of: C4-C6 linear mono-alcohols, branched C4-C10 mono-alcohols having one or more C1-C4 branching groups, alkyl mono-glycerols, and mixtures thereof, is known.

SUMMARY OF THE INVENTION

The present disclosure relates to a laundry detergent composition comprising: detersive surfactant, wherein the detersive surfactant comprises a combination of anionic and nonionic surfactant; solvent selected from the group consisting of: C4-C10 alkyl branched alcohols, and mixtures thereof, wherein "C4-C10 alkyl" refers to the primary alkyl chain, and refers to the weight average alkyl chain length, and wherein the composition has a pH of from 6.0 to 8.9.

The present disclosure further relates to a method of laundering fabric, preferably a stained fabric, comprising the steps of: providing a laundry detergent composition according to any preceding claim; diluting the laundry detergent composition to provide a wash liquor having a total surfactant concentration of greater than 300 ppm; and washing fabric in the wash liquor.

The present disclosure further relates to the use of solvent selected from the group consisting of: C4-C10 alkyl branched alcohols, and mixtures thereof, in a laundry detergent composition, for removing stains comprising natural oil and/or natural grease from fabrics.

DETAILED DESCRIPTION OF THE INVENTION

Laundry detergent compositions comprising C4-C10 alkyl branched alcohols, and mixtures thereof, have been found to provide improved removal of grease-containing stains, both via pre-treatment and also through the wash. Such grease removal benefits can be achieved using relatively low levels of the solvent. In addition, the solvents improve the viscosity of liquid laundry detergent compositions.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

All measurements are performed at 25° C. unless otherwise specified.

As used herein, the articles including "a" and "an" when used in a claim, are understood to mean one or more of what is claimed or described.

Detergent Composition:

As used herein, "liquid detergent composition" refers to liquid detergent composition which is fluid, and preferably capable of wetting and cleaning a fabric, e.g., clothing in a domestic washing machine. As used herein, "laundry detergent composition" refers to compositions suitable for washing clothes. The composition can include solids or gases in suitably subdivided form, but the overall composition excludes product forms which are non-fluid overall, such as tablets or granules. The liquid laundry detergent composition preferably has a density in the range from 0.9 to 1.3 grams per cubic centimeter, more specifically from 1.00 to 1.10 grams per cubic centimeter, excluding any solid additives but including any bubbles, if present.

Aqueous liquid laundry detergent compositions are preferred. For such aqueous liquid laundry detergent compositions, the water content can be present at a level of from 5% to 99%, preferably from 15% to 90%, more preferably from 25% to 80% by weight of the liquid detergent composition.

The pH range of the detergent composition is from 6.0 to 8.9, preferably from pH 7 to 8.8.

Detersive Surfactants

Detersive surfactant as used herein means surfactants or mixtures of surfactants that provide cleaning, stain removing, or laundering benefit to soiled material. Suitable detersive surfactants can be: anionic surfactant, nonionic surfactant, zwitterionic surfactant, and combinations thereof. The detersive surfactant comprises a combination of anionic and nonionic surfactant.

The laundry composition can comprises detersive surfactant at a level of from 1 wt % to 70 wt %, preferably from 10 wt % to 50 wt %, more preferably from 15 wt % to 35 wt %.

Suitable anionic surfactants can be selected from the group consisting of: alkyl sulphates, alkyl ethoxy sulphates, alkyl sulphonates, alkyl benzene sulphonates, fatty acids and their salts, and mixtures thereof. However, by nature, every anionic surfactant known in the art of detergent compositions may be used, such as disclosed in "Surfactant Science Series", Vol. 7, edited by W. M. Linfield, Marcel Dekker. However, the composition preferably comprises at least a sulphonic acid surfactant, such as a linear alkyl benzene sulphonic acid, but water-soluble salt forms may also be used. Alkyl ethoxy sulphates, or mixtures thereof, are also preferred.

Anionic sulfonate or sulfonic acid surfactants suitable for use herein include the acid and salt forms of linear or branched alkylbenzene sulfonates, alkyl ester sulfonates, alkane sulfonates, alkyl sulfonated polycarboxylic acids, and mixtures thereof. Suitable anionic sulfonate or sulfonic acid surfactants include: C5-C20 alkylbenzene sulfonates, more preferably C10-C16 alkylbenzene sulfonates, more preferably C11-C13 alkylbenzene sulfonates, C5-C20 alkyl ester sulfonates, C6-C22 primary or secondary alkane sulfonates, C5-C20 sulfonated polycarboxylic acids, and any mixtures thereof, but preferably C11-C13 alkylbenzene sulfonates. The aforementioned surfactants can vary widely in their 2-phenyl isomer content.

Anionic sulphate salts suitable for use in the compositions of the invention include the primary and secondary alkyl sulphates, having a linear or branched alkyl or alkenyl moiety having from 9 to 22 carbon atoms or more preferably 12 to 18 carbon atoms. Also useful are beta-branched alkyl sulphate surfactants or mixtures of commercial available materials, having a weight average (of the surfactant or the mixture) branching degree of at least 50%.

Mid-chain branched alkyl sulphates or sulfonates are also suitable anionic surfactants for use in the compositions of the invention. Preferred are the C5-C22, preferably C10-C20 mid-chain branched alkyl primary sulphates. When mixtures are used, a suitable average total number of carbon atoms for the alkyl moieties is preferably within the range of from greater than 14.5 to 17.5. Preferred mono-methyl-branched primary alkyl sulphates are selected from the group consisting of the 3-methyl to 13-methyl pentadecanol sulphates, the corresponding hexadecanol sulphates, and mixtures thereof. Dimethyl derivatives or other biodegradable alkyl sulphates having light branching can similarly be used.

Other suitable anionic surfactants for use herein include fatty methyl ester sulphonates and/or alkyl alkoxylated sulphates such as alkyl ethoxy sulphates (AES) and/or alkyl polyalkoxylated carboxylates (AEC). When used, the alkyl alkoxylated sulphate surfactant is preferably a blend of one or more alkyl ethoxylated sulphates. Suitable alkyl alkoxylated sulphates include C10-C18 alkyl ethoxylate, more preferably C12-C15 alkyl ethoxylate, with a degree of ethoxylation of from 1 to 5, preferably from 2 to 3.

The anionic surfactants are typically present in the form of their salts with alkanolamines or alkali metals such as sodium and potassium.

For improved stability and grease cleaning, the liquid detergent composition can comprise linear alkyl benzene sulfonate surfactant and alkyl alkoxylated sulphate surfactant, such that the ratio of linear alkyl benzene sulfonate surfactant to alkyl alkoxylated sulphate surfactant is from 0.1 to 5, preferably from 0.25 to 3, more preferably from 0.6 to 1.1.

The liquid detergent composition can comprise nonionic surfactant. The level of nonionic surfactant in the liquid detergent composition can be present at a level of less than 10 wt %, preferably less than 5 wt %, more preferably less than 1 wt %, most preferably less than 0.5 wt %.

Suitable nonionic surfactants include, but are not limited to C12-C18 alkyl ethoxylates ("AE") including the so-called narrow peaked alkyl ethoxylates and C6-C12 alkyl phenol alkoxylates (especially ethoxylates and mixed ethoxy/propoxy), block alkylene oxide condensate of C6-C12 alkyl phenols, alkylene oxide condensates of C8-C22 alkanols and ethylene oxide/propylene oxide block polymers (Pluronic-BASF Corp.), as well as semi polar nonionics (e.g., amine oxides and phosphine oxides) can be used in the present compositions. An extensive disclosure of these types of surfactants is found in U.S. Pat. No. 3,929,678, Laughlin et al., issued Dec. 30, 1975.

Alkylpolysaccharides such as disclosed in U.S. Pat. No. 4,565,647 Llenado are also useful nonionic surfactants in the compositions of the invention.

Also suitable are alkyl polyglucoside surfactants.

Nonionic surfactants of use include those of the formula $R_1(OC_2H_4)_nOH$, wherein $R_1$ is a C10-C16 alkyl group or a C8-C12 alkyl phenyl group, and n is from preferably 3 to 80. In some embodiments, the nonionic surfactants may be condensation products of C12-C15 alcohols with from 5 to 20 moles of ethylene oxide per mole of alcohol, e.g., C12-C13 alcohol condensed with 6.5 moles of ethylene oxide per mole of alcohol Suitable amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain.

Suitable amine oxides for use herein are for instance preferably $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

Additional suitable nonionic surfactants include polyhydroxy fatty acid amides of the formula:

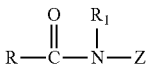

wherein R is a C9-17 alkyl or alkenyl, R1 is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798.

The liquid detergent composition can comprise a zwitterion. The zwitterion can be present at a level of from 0.1 wt % to 5 wt %, preferably from 0.2 wt % to 2 wt %, more preferably from 0.4 wt % to 1 wt %.

Suitable amphoteric or zwitterionic detersive surfactants include those which are known for use in hair care or other personal care cleansing. Non-limiting examples of suitable zwitterionic or amphoteric surfactants are described in U.S. Pat. No. 5,104,646 (Bolich Jr. et al.), U.S. Pat. No. 5,106,609 (Bolich Jr. et al.). Suitable amphoteric detersive surfactants include those surfactants broadly described as derivatives of aliphatic secondary and tertiary amines in which the aliphatic radical can be straight or branched chain and wherein one of the aliphatic substituents contains from 8 to 18 carbon atoms and one contains an anionic group such as carboxy, sulfonate, sulfate, phosphate, or phosphonate. Suitable amphoteric detersive surfactants for use in the present invention include, but are not limited to: cocoamphoacetate, cocoamphodiacetate, lauroamphoacetate, lauroamphodiacetate, and mixtures thereof.

Preferably surfactants comprising saturated alkyl chains are used.

Solvent

Suitable solvents are selected from the group consisting of: C4-C10 alkyl branched alcohols, and mixtures thereof. Such solvents have been found to improve the grease removal in detergent compositions when used during pretreatment of fabrics. Even more surprisingly, detergent compositions comprising such solvents have been found to improve grease removal even when during washing without pretreatment, and even when the solvents are present at low levels. Detergent compositions comprising such solvents are particularly effective at removing oils or grease which are at least partially naturally derived, such as animal fat, vegetable fat, and mixtures thereof, from fabrics. In addition, the solvents can improve the rheological profile of liquid detergent compositions.

"C4-C10 alkyl" refers to the primary alkyl chain, and refers to the weight average alkyl chain length. Preferred C4-C10 alkyl branched alcohols are C4-C10 primary monoalcohols having one or more C1-C4 branching groups, preferably selected from the group consisting of: methyl butanol, ethyl butanol, methyl pentanol, ethyl pentanol, methyl hexanol, ethyl hexanol, propyl hexanol, dimethyl hexanol, trimethyl hexanol, methyl heptanol, ethyl heptanol, propyl heptanol, dimethyl heptanol, trimethyl heptanol, methyl octanol, ethyl octanol, propyl octanol, butyl octanol, dimethyl octanol, trimethyl octanol, methyl nonanol, ethyl nonanol, propyl nonanol, butyl nonanol, dimethyl nonanol, trimethyl nonanol and mixtures thereof.

More preferred C4-C10 alkyl branched alcohols are C6-C8 alkyl branched alcohols, preferably selected from the group consisting of: methyl hexanol, ethyl hexanol, propyl hexanol, dimethyl hexanol, trimethyl hexanol, methyl heptanol, ethyl heptanol, propyl heptanol, dimethyl heptanol, trimethyl heptanol, methyl octanol, ethyl octanol, propyl octanol, butyl octanol, dimethyl octanol, trimethyl octanol, and mixtures thereof.

Even more preferred are C6-C7 alkyl branched alcohols, and mixtures thereof. Most preferably, the solvent is selected from the group consisting of: 2-ethylhexanol, 3,5,5-trimethyl-1-hexanol, 2-propylheptanol, and mixtures thereof.

The laundry detergent composition can comprise the solvent at a level of from 0.1 wt % to 10 wt %, preferably from 0.3 wt % to 7.5 wt %, preferably from 0.5 wt % to 5 wt % of the solvent.

For the present invention, alkanolamines, such as monoethanolamine and triethanolamine, are considered as alkali agents, or neutralising agents for anionic surfactants and the like, but not as solvents.

Optional Ingredients

The detergent composition may additionally comprise one or more of the following optional ingredients: external structurant or thickener, enzymes, enzyme stabilizers, cleaning polymers, bleaching systems, optical brighteners, hueing dyes, particulate material, perfume and other odour control agents, hydrotropes, suds suppressors, fabric care benefit agents, pH adjusting agents, dye transfer inhibiting agents, preservatives, non-fabric substantive dyes and mixtures thereof. In more preferred embodiments, the laundry detergent composition does not comprise a bleach.

External structurant or thickener: Preferred external structurants and thickeners are those that do not rely on charge—charge interactions for providing a structuring benefit. As such, particularly preferred external structurants are uncharged external structurants, such as those selected from the group consisting of: non-polymeric crystalline, hydroxyl functional structurants, such as hydrogenated castor oil; microfibrillated cellulose; uncharged hydroxyethyl cellulose; uncharged hydrophobically modified hydroxyethyl cellulose; hydrophobically modified ethoxylated urethanes; hydrophobically modified non-ionic polyols; and mixtures thereof.

Suitable non-polymeric crystalline, hydroxyl functional structurants are known in the art, and generally comprise a cystallizable glyceride which can be pre-emulsified to aid dispersion into the final liquid detergent composition. A non-limiting example of such a pre-emulsified external structuring system comprises: (a) crystallizable glyceride(s); (b) anionic surfactant; and (c) water and optionally, non-aminofunctional organic solvents. Each of these components is discussed in detail below. The preferred non-polymeric crystalline, hydroxy-functional structurant comprises a crystallizable glyceride, preferably hydrogenated castor oil or "HCO".

Suitable polymeric structurants include naturally derived and/or synthetic polymeric structurants.

Examples of naturally derived polymeric structurants of use in the present invention include: microfibrillated cellulose, hydroxyethyl cellulose, hydrophobically modified hydroxyethyl cellulose, carboxymethyl cellulose, polysaccharide derivatives and mixtures thereof. Non-limiting examples of microfibrillated cellulose are described in WO 2009/101545 A1. Suitable polysaccharide derivatives include: pectine, alginate, arabinogalactan (gum Arabic), carrageenan, gellan gum, xanthan gum, guar gum and mixtures thereof.

Examples of synthetic polymeric structurants or thickeners of use in the present invention include: polycarboxylates, hydrophobically modified ethoxylated urethanes (HEUr), hydrophobically modified non-ionic polyols and mixtures thereof.

Preferably the polycarboxylate polymer is a polyacrylate, polymethacrylate or mixtures thereof. In another preferred embodiment, the polyacrylate is a copolymer of unsaturated mono- or di-carbonic acid and 1-30 C alkyl ester of the (meth) acrylic acid. Such copolymers are available from Noveon inc under the tradename Carbopol Aqua 30. Suitable polyacrylates include alkali swellable emulsion (ASE) thickeners and hydrophobically modified alkali sellable emulsion (HASE) thickeners. Suitable hydrophobically modified alkali swellable emulsions (HASE) are sold under the various brand names by Lubrizol Corporation, Clariant, Akzo Nobel, Coatex, 3V Sigma, SEPPIC, Ashland and BASF. Particularly suited, are Novethix L10 and Novethix HC200 (Lubrizol), Crystasense Sapphire (Clariant), Alcoguard 5800 (Akzo Nobel), Rheosolve 637 and Rheosolve 650 (Coatex), Polygel W30 (3V Sigma), Capige198 (SEPPIC), Jaypol AT4 (Ashland), Rheovis AT120, Salcare SC80 and Luvigel FIT (BASF)."

The branched solvents of the present invention have been surprisingly found to synergistically improve both the viscosity and yield strength provided by the external structurant or thickener, while maintaining the dispersibility of the liquid detergent composition. In addition, the branched alcohols have surprisingly been found to result in structuring in addition to thickening, when combined with polymeric thickeners.

Preferably, the aqueous liquid detergent composition has a viscosity of 50 to 5,000, preferably 75 to 1,000, more preferably 100 to 500 mPa·s, when measured at a shear rate of 100 s-1, at a temperature of 20° C. For improved phase stability, and also improved stability of suspended ingredients, the aqueous liquid detergent composition has a viscosity of 50 to 250,000, preferably 5,000 to 125,000, more preferably 10,000 to 35,000 mPa·s, when measured at a shear rate of 0.05 s-1, at a temperature of 20° C.

Cleaning polymers: Suitable cleaning polymers provide for broad-range soil cleaning of surfaces and fabrics and/or suspension of the soils. Any suitable cleaning polymer may be of use. Useful cleaning polymers are described in USPN 2009/0124528A1. Non-limiting examples of useful categories of cleaning polymers include: amphiphilic alkoxylated grease cleaning polymers; clay soil cleaning polymers; soil release polymers; and soil suspending polymers. The detergent composition may comprise amphiphilic alkoxylated grease cleaning polymers, which may have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkyleneimines, for example. Such compounds may comprise, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The alkoxylated polyalkyleneimines may have an inner polyethylene oxide block and an outer polypropylene oxide block. Other suitable cleaning polymers include polyester based soil release polymers, such as SRA300, supplied by Clariant. The detergent compositions may comprise from 0.1% to 10%, preferably, from 0.1% to 8%, more preferably from 0.1% to 6%, by weight of the detergent composition, of alkoxylated polyamines.

Polymer Deposition Aid: The laundry detergent composition can comprise from 0.1% to 7%, more preferably from 0.2% to 3%, of a polymer deposition aid. As used herein, "polymer deposition aid" refers to any cationic polymer or combination of cationic polymers that significantly enhance deposition of a fabric care benefit agent onto the fabric during laundering. Suitable polymer deposition aids can comprise a cationic polysaccharide and/or a copolymer. "Fabric care benefit agent" as used herein refers to any material that can provide fabric care benefits. Non-limiting examples of fabric care benefit agents include: silicone derivatives, oily sugar derivatives, dispersible polyolefins, polymer latexes, cationic surfactants and combinations thereof. Preferably, the deposition aid is a cationic or amphoteric polymer. The cationic charge density of the polymer preferably ranges from 0.05 milliequivalents/g to 6 milliequivalents/g. The charge density is calculated by dividing the number of net charge per repeating unit by the molecular weight of the repeating unit. In one embodiment, the charge density varies from 0.1 milliequivalents/g to 3 milliequivalents/g. The positive charges could be on the backbone of the polymers or the side chains of polymers.

Organic builder and/or chelant: The laundry detergent composition can comprise from 0.6% to 10%, preferably from 2 to 7% by weight of one or more organic builder and/or chelants. Suitable organic builders and/or chelants are selected from the group consisting of: MEA citrate, citric acid, aminoalkylenepoly(alkylene phosphonates), alkali metal ethane 1-hydroxy disphosphonates, and nitrilotrimethylene, phosphonates, diethylene triamine penta (methylene phosphonic acid) (DTPMP), ethylene diamine tetra (methylene phosphonic acid) (DDTMP), hexamethylene diamine tetra(methylene phosphonic acid), hydroxy-ethylene 1,1 diphosphonic acid (HEDP), hydroxyethane dimethylene phosphonic acid, ethylene di-amine di-succinic acid (EDDS), ethylene diamine tetraacetic acid (EDTA), hydroxyethylethylenediamine triacetate (HEDTA), nitrilotriacetate (NTA), methylglycinediacetate (MGDA), iminodisuccinate (IDS), hydroxyethyliminodisuccinate (HIDS), hydroxyethyliminodiacetate (HEIDA), glycine diacetate (GLDA), diethylene triamine pentaacetic acid (DTPA), catechol sulfonates such as Tiron™ and mixtures thereof.

Enzymes: Suitable enzymes provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, lignines, pullulanases, tannases, pentosanases, malanases, ß-glucanases, arabinosidases, hyaluronidase, chondroitinase, laccase, and known amylases, or combinations thereof.

A preferred enzyme combination comprises a cocktail of conventional detersive enzymes such as protease, lipase, cutinase and/or cellulase in conjunction with amylase. Detersive enzymes are described in greater detail in U.S. Pat. No. 6,579,839.

Enzyme stabiliser: Enzymes can be stabilized using any known stabilizer system such as calcium and/or magnesium compounds, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compound, polyamide oligomer, glycolic acid or its salts; poly hexa methylene bi guanide or N,N-bis-3-amino-propyl-dodecyl amine or salt; and mixtures thereof.

Hueing dyes: The detergent composition may comprise fabric hueing agent (sometimes referred to as shading, bluing, or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and combinations thereof.

Optical brighteners: The detergent composition may comprise, based on the total detergent composition weight, from 0.005 to 2%, preferably 0.01 to 0.1% of a fluorescent agent (optical brightener). Fluorescent agents are well known and many fluorescent agents are available commercially. Usually, these fluorescent agents are supplied and used in the form of their alkali metal salts, for example, the sodium salts. Preferred classes of fluorescent agent are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2-(4-styryl-3-sulfophenyl)-2H-napthol[1,2-d]trazole, disodium 4,4'-bis{[(4-anilino-6-(N methyl-N-2 hydroxyethyl) amino 1,3,5-triazin-2-yl)]amino}stilbene-2-2' disulfonate, disodium 4,4'-bis{[(4-anilino-6-morpholino-1,3,5-triazin-2-yl)]amino}stilbene-2-2' disulfonate, and disodium 4,4'-bis(2-sulfoslyryl)biphenyl.

Hydrotrope: The detergent composition may comprise, based on the total detergent composition weight, from 0 to 30%, preferably from 0.5 to 5%, more preferably from 1.0 to 3.0%, which can prevent liquid crystal formation. The addition of the hydrotrope thus aids the clarity/transparency of the composition. Suitable hydrotropes comprise but are not limited to urea, salts of benzene sulphonate, toluene sulphonate, xylene sulphonate or cumene sulphonate. Preferably, the hydrotrope is selected from the group consisting of propylene glycol, xylene sulfonate, ethanol, and urea to provide optimum performance.

Particles: The composition can also comprise particles, especially when the composition further comprises a structurant or thickener. The composition may comprise, based on the total composition weight, from 0.02% to 10%, preferably from 0.1% to 4%, more preferably from 0.25% to 2.5% of particles. Said particles include beads, pearlescent agents, microcapsules, and mixtures thereof.

Microcapsules: Suitable capsules are typically formed by at least partially, preferably fully, surrounding a benefit agent with a wall material. Preferably, the capsule is a perfume capsule, wherein said benefit agent comprises one or more perfume raw materials. The capsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol, resorcinol-based materials, poly-isocyanate-based materials, acetals (such as 1,3,5-triol-benzene-gluteraldehyde and 1,3,5-triol-benzene melamine), starch, cellulose acetate phthalate and mixtures thereof. Preferably, the capsule wall comprises melamine and/or a polyacrylate based material. The perfume capsule may be coated with a deposition aid, a cationic polymer, a non-ionic polymer, an anionic polymer, or mixtures thereof. Preferably, the perfume capsules have a volume weighted mean particle size from 0.1 microns to 100 microns, preferably from 0.5 microns to 60 microns. Especially where the composition comprises capsules having a shell formed at least partially from formaldehyde, the composition can additionally comprise one or more formaldehyde scavengers.

Process of Making the Laundry Detergent Composition:

The laundry detergent compositions can be made using any suitable process known to the skilled person. Typically, the ingredients are blended together in any suitable order. Preferably, the detersive surfactants are added as part of a concentrated premix, to which are added the other optional ingredients. Preferably, the solvent is added either last, or if an external structurant is added, immediately before the external structurant, with the external structurant being added as the last ingredient.

Method of Laundering Fabrics:

The laundry detergent compositions of the present invention can be used to launder fabrics. In such methods, the laundry detergent composition is diluted to provide a wash liquor having a total surfactant concentration of greater than 300 ppm, preferably from 400 ppm to 2,500 ppm, more preferably from 600 ppm to 1000 ppm. The fabric is then washed in the wash liquor, and preferably rinsed.

The method of the present invention is particularly suited for removing stains, especially removing stains comprising natural oil and/or grease, such as animal fat, vegetable fat, and mixtures thereof.

Methods:

A) pH Measurement:

The pH is measured, at 25° C., using a Santarius PT-10P pH meter with gel-filled probe (such as the Toledo probe, part number 52 000 100), calibrated according to the instructions manual. The pH is measured in a 10% dilution in demineralised water (i.e. 1 part laundry detergent composition and 9 parts demineralised water).

B) Method of Measuring Viscosity:

The viscosity is measured using an AR 2000 rheometer from TA instruments using a cone and plate geometry with a 40 mm diameter and an angle of 1°. The viscosity at the different shear rates is measured via a logarithmic shear rate sweep from 0.1 $s^{-1}$ to 1200 $s^{-1}$ in 3 minutes time at 20° C. Low shear viscosity is measured at a continuous shear rate of 0.05 $s^{-1}$.

EXAMPLES

A following laundry detergent compositions were prepared by simple mixing, comprising 5 wt % of different solvents, except for comparative example C, which comprised no solvent:

| | Ex. 1 wt % | Ex. 2 wt % | Ex. 3 wt % | Ex. A* wt % | Ex. B* wt % | Ex. C* wt % |
|---|---|---|---|---|---|---|
| Linear C10-C12 alkyl benzene sulfonate | 4.8 | 4.8 | 4.8 | 4.8 | 4.8 | 4.8 |
| C12-C14 alkyl ethoxylated (EO3) sulfate | 2.2 | 2.2 | 2.2 | 2.2 | 2.2 | 2.2 |
| C45 EO7 ethoxylated nonionic surfactant | 3.6 | 3.6 | 3.6 | 3.6 | 3.6 | 3.6 |
| Topped kernel fatty acid | 2.5 | 2.5 | 2.5 | 2.5 | 2.5 | 2.5 |
| Citric acid | 1.7 | 1.7 | 1.7 | 1.7 | 1.7 | 1.7 |
| 2-ethylhexanol | 5 | — | — | — | — | — |
| 3,5,5-trimethyl-1-hexanol | — | 5 | — | — | — | — |
| 2-propylheptanol | — | — | 5 | — | — | — |
| 1,2 propanediol | — | — | — | 5 | — | — |
| 1-butanol | — | — | — | — | 5 | — |
| Sodium hydroxide | to pH 8.4 | to pH 8.4 | to pH 8.4 | to pH 8.4 | to pH 8.4 | to pH 8.4 |
| Water | to 100% | to 100% | to 100% | to 100% | to 100% | to 100% |

*comparative 100 ml of each composition was tested in a full-scale wash test to compare stain removal performance of the compositions of the present invention, versus the comparative compositions.

Knitted cotton swatches (30 cm×30 cm) comprising fatty stains, including cooked beef, bacon grease and make-up stains were ordered from Warwick Equest.

The stains were pretreated by applying 1 ml of the composition and scrubbing 10 times with an Ariel pretreat dosing cap (10 vertical strokes). The treated stains were then left for 5 minutes before placing in a Miele W527 washing machine with 3 Kg of mixed load (13 cotton and 10 poly-cotton fabrics, 30 cm×30 cm) and the remaining laundry detergent composition (to 100 ml) was dosed via a dosing ball. The wash test was run with a cotton short cycle at 30° C. and 2.5 mMol water hardness.

The wash test was repeated 4 times, with 2 replicates in each load, resulting in 8 test replicates per composition.

The fabric stain removal was graded using a Hunter Colorquest by measuring the amount of stain that is left after washing compared to an initial unwashed set. The results of the stain removal data were averaged for each stain and each product to give the overall stain removal index (SRI) grade vs. the reference (comparative example C, comprising no solvent).

The response was measured at 460 nm and used to calculate the soil removal delta in % (ASR) according to the following formula:

for calculating the soil removal delta in % ($\Delta SR$) Formula 1

$$\Delta SRI = \frac{R_{before} - R_{after}}{R_{before} - R_{clean}} \times 100\%$$

$R_{before}$ = Remission before washing $R_{after}$ = Remission after washing $R_{clean}$ = Remission from clean white cotton The results are shown on the tables below (versus Ex. C, comprising no solvent):

| Stain | Ex. C ΔSRI (%) | Ex. 1 Change in ΔSRI (%) | Ex. 2 Change in ΔSRI (%) | Ex. 3 Change in ΔSRI (%) |
|---|---|---|---|---|
| Cooked beef | 60.3 | +12.9 | +12.5 | +9.1 |
| Bacon grease | 60.5 | +12.8 | +15.1 | +11.3 |
| Make up | 68.9 | +18.7 | +18.7 | +17.6 |

-continued

| Stain | Ex. C SRI (%) | Ex. A Change in ΔSRI (%) | Ex. B Change in ΔSRI (%) | Ex. 3 Change in ΔSRI (%) |
|---|---|---|---|---|
| Cooked beef | 66.3 | −2.1 | +4.4 | +17.1 |
| Bacon grease | 52.3 | −0.9 | −1.1 | +26.4 |
| Make up | 66.8 | −7.9 | −14.1 | +21.9 |

As can be seen from the above data, pretreating and washing with laundry detergent compositions of the present invention, comprising the branched alcohol, resulted in improved removal of greasy stains.

A following laundry detergent compositions were prepared by simple mixing, comprising 2 wt % of different solvents:

| | Ex. 4 wt % | Ex. D* wt % | Ex. E* wt % |
|---|---|---|---|
| Linear C10-C12 alkyl benzene sulfonate | 4.8 | 4.8 | 4.8 |
| C12-C14 alkyl ethoxylated (EO3) sulfate | 2.2 | 2.2 | 2.2 |
| C45 EO7 ethoxylated nonionic surfactant | 3.6 | 3.6 | 3.6 |
| Topped kernel fatty acid | 2.5 | 2.5 | 2.5 |
| Citric acid | 1.7 | 1.7 | 1.7 |
| 2-propylheptanol | 2 | — | — |
| 1,2-propanediol | — | 2 | — |
| 1-butanol | — | — | 2 |
| Sodium hydroxide | to pH 8.4 | to pH 8.4 | to pH 8.4 |
| Water | to 100% | to 100% | to 100% |

*comparative

The stain removal test was repeated, using example D (2 wt % propanediol) as reference, with the following results:

| Stain | Ex. D* SRI (%) | Ex. 4 ΔSRI (%) | Ex. E* ΔSRI (%) |
|---|---|---|---|
| Cooked beef | 71.5 | +14.0 | +1.0 |
| Bacon grease | 53.4 | +17.6 | −0.6 |
| Make up | 63.1 | +25.0 | −1.8 |

As can be seen from the above data, laundry detergent compositions of the present invention, comprising the branched alcohol, resulted in improved removal of greasy stains, even when the solvent is added at 2 wt %.

The stain removal test was repeated using the same conditions, except that no pretreatment step was used, with example D (2 wt % propanediol) as reference. The test used knitted cotton swatches (30 cm×30 cm) comprising fatty stains, including cooked beef, burnt butter, bacon grease and make-up stains. All other test settings remained the same.

The results are given in the table below:

| Stain | Ex. D* SRI (%) | Ex. 4 ΔSRI (%) | Ex. E* ΔSRI (%) |
|---|---|---|---|
| Cooked beef | 47.5 | +14.0 | +3.3 |
| Burnt butter | 57.1 | +14.9 | +2.2 |
| Bacon grease | 46.3 | +11.9 | +0.3 |
| Make up | 41.5 | +33.2 | +1.2 |

As can be seen from the above data, laundry detergent compositions of the present invention, comprising the branched alcohol, resulted in improved removal of greasy stains, even when the solvent is added at 2 wt % and even when no pretreatment was done on the stained fabrics.

The following laundry detergent compositions were prepared by simple mixing, with example F being comparative and comprising no solvent, and examples 10 to 12 being of the invention, comprising various levels of 2-propylheptanol and surfactant:

| | Ex. F* wt % | Ex. 10 wt % | Ex. 11 wt % | Ex. 12 wt % |
|---|---|---|---|---|
| Linear C10-C12 alkyl benzene sulfonate | 4.8 | 3.9 | 4.4 | 4.6 |

-continued

| | Ex. F* wt % | Ex. 10 wt % | Ex. 11 wt % | Ex. 12 wt % |
|---|---|---|---|---|
| C12-C14 alkyl ethoxylated (EO3) sulfate | 2.2 | 1.8 | 2.0 | 2.1 |
| C45 EO7 ethoxylated nonionic surfactant | 3.6 | 2.9 | 3.2 | 3.4 |
| Topped kernel fatty acid | 2.5 | 2.1 | 2.3 | 2.4 |
| Citric acid | 1.7 | 1.7 | 1.7 | 1.7 |
| 2-propylheptanol | — | 2 | 1 | 0.5 |
| Sodium hydroxide | to pH 8.4 | to pH 8.4 | to pH 8.4 | to pH 8.4 |
| Water | to 100% | to 100% | to 100% | to 100% |

The stain removal test was repeated using the same conditions, with no pretreatment step, using comparative example F (0 wt % 2-propylheptanol) as the reference. The test used knitted cotton swatches (30 cm×30 cm) comprising fatty stains, including cooked beef, burnt butter, bacon grease and make-up stains. All other test settings remained the same as with the earlier described test.

The results are given in the table below:

| Stain | Ex. F* SRI (%) | Ex. 10 ΔSRI (%) | Ex. 11 ΔSRI (%) | Ex. 12 ΔSRI (%) |
|---|---|---|---|---|
| Cooked beef | 48.2 | +14.7 | +7.2 | +2.5 |
| Burnt butter | 64.1 | +10.7 | +4.9 | +0.1 |
| Bacon grease | 49.9 | +7.5 | +3.6 | −0.2 |
| Make up | 44.4 | +21.7 | +16.6 | +3.9 |

As can be seen from the above data, laundry detergent compositions of the present invention, comprising the branched alcohol, resulted in improved removal of greasy stains, even when the solvent is added down to 0.5 wt %, even at reduced surfactant levels, and even when the detergent composition is added as part of the main wash, with no pretreat step.

Examples 13 to 18 are non-limiting embodiments of the present invention. Percentages are by weight unless otherwise specified.

| | Ex. 13 wt % | Ex. 14 wt % | Ex. 15 wt % | Ex. 16 wt % | Ex. 17 wt % | Ex. 18 wt % |
|---|---|---|---|---|---|---|
| C12-14 EO3 alkyl ethoxylated sulfate | 9.8 | 4.0 | 0.6 | 7.1 | 9.1 | 3.4 |
| C12-15 linear alkylbenzene sulfonic acid | 14.5 | 9.2 | 5.9 | 10.8 | 6.9 | 4.6 |
| C12-15 EO8 ethoxylated alcohol | 2.0 | 4.0 | 3.0 | 7.0 | 6 | 4.6 |
| Dodecydimethylamine-N-oxide | 0 | 0.5 | 0 | 0 | 0 | 0 |
| Citric Acid | 4.8 | 2.8 | 1.9 | 2.8 | 3.3 | 2.2 |
| C12-18 Fatty Acid | 3.3 | 1.7 | 1.2 | 4.7 | 4.9 | 1.6 |
| Sodium Cumene Sulfonate | 0 | 1.7 | 0.2 | 0 | 0 | 0 |
| Zwitterionic polyamine[1] | 0.7 | 0.7 | 0.3 | 0 | 0 | 0 |
| Diethylenetriamine penta(methylene phosphonic acid), Sodium salt (DTPMP) | 0 | 0.5 | 0.2 | 0 | 0.5 | 0.2 |
| 1-hydroxyethane 1,1-diphosphonic acid (HEDP) | 0.6 | 0 | 0 | 2.0 | 0 | 0 |
| Mannanase[2] | 0.003 | 0.002 | 0 | 0 | 0.0002 | 0.002 |
| Amylase[3] | 0.013 | 0.004 | 0.0016 | 0 | 0.02 | 0.005 |
| Protease[4] | 0.039 | 0.02 | 0.018 | 0 | 0.06 | 0.008 |
| Cellulase[5] | 0 | 0 | 0 | 0 | 0.006 | 0 |
| Pectate Lyase[6] | 0.005 | 0.002 | 0 | 0 | 0.001 | 0 |
| Lipase[7] | 0 | 0 | 0 | 0 | 0.010 | 0 |
| PEG-PVAc Polymer[8] | 1.9 | 1.3 | 0.9 | 0 | 0 | 0 |
| Di-ethoxylated poly (1,2 propylene terephtalate) short block soil release polymer[9] | 0 | 0 | 0 | 0 | 0.55 | 0 |

-continued

| | Ex. 13 wt % | Ex. 14 wt % | Ex. 15 wt % | Ex. 16 wt % | Ex. 17 wt % | Ex. 18 wt % |
|---|---|---|---|---|---|---|
| Ethoxylated Polyethylenimine [10] | 0 | 0 | 0 | 1.2 | 0 | 0 |
| Brightener 49 | 0.08 | 0.05 | 0.05 | 0.24 | 0 | 0.05 |
| Bis azo or azo thiophene hueing dye[11] | 0 | 0 | 0.02 | 0 | 0 | 0 |
| Hydrogenated castor oil | 1 | 0.30 | 0.44 | 0 | 0 | 0 |
| 2-propylheptanol | 5 | — | — | 6 | 1 | 0.5 |
| 2-ethylhexanol | — | 2 | — | — | — | 1 |
| 3,5,5-trimethyl-1-hexanol | — | — | 3 | — | 4 | — |
| 1,2 propanediol | 8.3 | 1.3 | 1.0 | 9.2 | 6.1 | 3.6 |
| Ethanol | 0 | 0 | 0.5 | 0 | 1.9 | 0 |
| Glycerine | 0 | 0 | 0 | 0.5 | 0.3 | 1.0 |
| Sodium formate | 0 | 0.03 | 0.3 | 0 | 0 | 0 |
| Calcium Chloride | 0.03 | 0.01 | 0.006 | 0 | 0 | 0 |
| Boric acid | 0 | 0 | 0 | 0 | 1.1 | 1.8 |
| Monoethanolamine | 8.8 | 0.24 | 0.35 | 6.1 | 0 | 0 |
| Triethanolamine | 0 | 0 | 0 | 4.1 | 0 | 0 |
| Sodium hydroxide | to pH 7.4 | to pH 7.9 | to pH 8.0 | to pH 8.8 | to pH 8.5 | to pH 8.3 |
| Acticide MBS2550 | 0.003 | 0.001 | 0.001 | 0.01 | 0.03 | 0.02 |
| Silicone suds suppressor | 0 | 0.003 | 0.003 | 0 | 0 | 0.02 |
| Perfume microcapsules | 0 | 0.25 | 0 | 0 | 0 | 0 |
| Perfume | 1.5 | 0.9 | 0.6 | 2.0 | 1.0 | 0.8 |
| Dye | 0.009 | 0.005 | 0.004 | 0 | 0.005 | 0.002 |
| Water | to 100% | to 100% | to 100% | to 100% | to 100% | to 100% |

[1]Zwitterionic ethoxylated quaternized sulfated hexamethylene diamine, supplied by BASF, Germany

[2]Mannanase enzyme originating from *Bacillus* sp. I633 available from Novozymes, Denmark

[3]Termamyl ® Ultra, available from Novozymes, Denmark

[4]Protease enzyme from *Bacillus Amyloliquefaciens* as described in EP 0 130 756 B1 published Jan. 9, 1985

[5]Carezyme ® available from Novozymes, Denmark

[6]Pectawash ® 20L, supplied by Novozymes, Denmark

[7]Lipex ®, supplied by Novozymes, Denmark

[8]Polyvinyl acetate grafted polyethylene oxide copolymer having a polyethylene oxide backbone and multiple polyvinyl acetate side chains, supplied by BASF, Germany.

[9]TexCare ® SRN-100, supplied by Clariant, Germany

[10] Polyethyleneimine (MW = 600) with 20 ethoxylate groups per —NH, supplied by BASF

[11]Supplied by Milliken, USA

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising:

a) from about 10 wt % to about 50 wt % of a detersive surfactant, wherein the detersive surfactant comprises a combination of anionic and nonionic surfactant;

b) solvent comprising 2-ethylhexanol; 3,5,5-trimethyl-1-hexanol; 2-propylheptanol; or a mixture thereof; and wherein the composition has a pH of from about 6.0 to about 8.9 and is free of bleach.

2. The laundry detergent composition according to claim 1, wherein the solvent comprises 2-propyl heptanol.

3. The laundry detergent composition according to claim 1, wherein the composition comprises solvent at a level of from about 0.1 wt % to about 10 wt %.

4. The laundry detergent composition according to claim 3, wherein the composition comprises solvent at a level of from about 0.3 wt % to about 7.5 wt %.

5. The laundry detergent composition according to claim 4, wherein the composition comprises solvent at a level of from about 0.5 wt % to about 5 wt %.

6. The laundry detergent composition according to claim 1, wherein the detersive surfactant consists essentially of anionic surfactant, non-ionic surfactant, or mixtures thereof.

7. The laundry detergent composition according to claim 1, wherein the anionic surfactant comprises linear alkyl benzene sulfonate and alkyl alkoxylated sulfate and the ratio of linear alkyl benzene sulfonate surfactant to alkyl alkoxylated sulphate surfactant is from about 0.1 to about 5.

8. The laundry detergent composition according to claim 7, wherein the laundry composition comprises detersive surfactant at a level of from about 15 wt % to about 35 wt %.

9. The laundry detergent composition according to claim 1, wherein the liquid laundry detergent composition comprises an external structurant or thickener selected from the group consisting of: non-polymeric crystalline, hydroxyl functional structurants; microfibrillated cellulose; uncharged hydroxyethyl cellulose; uncharged hydrophobically modified hydroxyethyl cellulose; hydrophobically modified ethoxylated urethanes; polyacrylates; hydrophobically modified non-ionic polyols; and mixtures thereof.

10. The laundry detergent composition according to claim 6, wherein the laundry composition further comprises particles, selected from the group consisting of: beads, pearlescent agents, microcapsules, and mixtures thereof.

11. The laundry detergent composition according to claim 10, wherein the laundry composition further comprises microcapsules.

12. The laundry detergent composition according to claim 1, wherein the laundry composition comprises enzymes, chelants, additional non-aminofunctional organic solvents, or a mixture thereof.

13. A laundry detergent composition comprising:

from about 5% to about 25% by weight of the composition of anionic surfactant;

from about 2% to about 10% by weight of the composition of nonionic surfactant;

from about 0.5% to about 5% by weight of the composition of a solvent comprising 2-ethylhexanol, 3,5,5-trimethyl-1-hexanol, 2-propylheptanol, or a mixture thereof; wherein the composition is free of bleach.

14. The laundry detergent of claim 13, wherein the anionic surfactant comprises an alkyl ethoxy sulfate surfactant, linear alkyl benzene sulfonate, or a combination thereof.

15. The laundry detergent of claim 14, wherein the nonionic surfactant comprises a C12-C18 alkyl ethoxylate.

16. The laundry detergent of claim 15, wherein the ratio by weight of linear alkyl benzene sulfonate to alkyl ethoxy sulfate surfactant is from about 0.6 to about 1.1.

17. The laundry detergent of claim 15, further comprising citric acid and a fatty acid.

18. The laundry detergent of claim 17, wherein the detergent comprises from about 6% to about 11%, by weigh of the detergent, of the anionic surfactant and from about 2% to about 5%, by weight of the detergent, of the nonionic surfactant.

* * * * *